United States Patent [19]

Barfield

[11] Patent Number: 4,605,074

[45] Date of Patent: Aug. 12, 1986

[54] METHOD AND APPARATUS FOR CONTROLLING BOREHOLE PRESSURE IN PERFORATING WELLS

[76] Inventor: Virgil H. Barfield, 3410 Mount Vernon, Houston, Tex. 77006

[21] Appl. No.: 661,207

[22] Filed: Oct. 15, 1984

Related U.S. Application Data

[63] Continuation-in-part of Ser. No. 459,771, Jan. 21, 1983, abandoned.

[51] Int. Cl.[4] ..... E21B 43/11; E21B 47/66

[52] U.S. Cl. ..... 175/4.52; 166/55; 166/297; 166/317; 166/386

[58] Field of Search ..... 175/4.52, 2, 4.6; 166/297, 298, 55, 55.1, 299, 317, 318, 164, 373, 386

[56] References Cited

U.S. PATENT DOCUMENTS

| | | | |
|---|---|---|---|
| 2,330,509 | 9/1943 | McCullough | 175/4.52 X |
| 3,163,112 | 12/1964 | Rhea | 166/297 X |
| 3,305,018 | 2/1967 | White, Jr. et al. | 175/4.52 X |
| 3,385,364 | 5/1968 | Whitten | 175/4.52 X |

*Primary Examiner*—Stephen J. Novosad

[57] ABSTRACT

A method and apparatus for controlling pressure in a borehole during perforation to provide means for maintaining a fluid column above the perforating zone to control a blowout while isolating the perforating zone from such fluid column to prevent incursion of the fluid column into the perforated zone immediately upon perforation. Provision is also made for a low pressure zone for inducing flow from the formation into the wellbore immediately upon perforation.

57 Claims, 17 Drawing Figures

METHOD AND APPARATUS FOR CONTROLLING BOREHOLE PRESSURE IN PERFORATING WELLS

PRIOR APPLICATION

This Application is a continuation-in-part of pending Application Ser. No. 459,771, filed Jan. 21, 1983, and now abandoned, the priority for the common subject matter which is hereby claimed.

FIELD OF THE INVENTION

This invention relates to oil well completion techniques, and more particularly to methods and apparatus for completing wells with a negative pressure differential across the formations while maintaining a positive pressure differential in the wellbore above the perforations.

BACKGROUND OF THE INVENTION

In the completion of oil and gas wells it is common practice to cement a casing or liner in a borehole and thereafter, perforate the casing or liner at one or more desired locations to provide flow paths into the casing or liner for the flow of oil and/or gas from the formation surrounding the casing for production of oil or gas. Typically a casing or liner in a completion operation contains a fluid such as drilling mud or other suitable fluid which provides sufficient hydrostatic pressure above the pressures encountered in the surrounding earth formations to prevent a well blowout. In perforating casing in earth formations where the oil or gas is under pressure in the formations, a number of variables are taken into consideration with respect to the productivity of oil or gas. For example, the projected depth of penetration into the earth formations, the number of perforations per foot of casing, the angular displacement of the various perforations around the axis of the casing and the diameter of the perforations are parameters affecting productivity. Additionally, the differential pressure, i.e., the difference in the pressure between the pressure in the earth formations penetrated by the perforations and the pressure in the interior of the casing at the time of perforating affects the productivity from the earth formations.

The differential pressure is a positive pressure when the pressure of the fluid column in the casing exceeds the pressure of the fluid in the reservoir or earth formations. In some instances the drilling mud pressure is from 500 to 1000 psi greater than the formation pressures. This positive pressure provides good well control and is considered by many operators to be the desired pressure mode where the perforations are made with large size perforating guns. However, while high penetration is achieved with larger perforating guns, the perforations in the formations are frequently plugged or clogged up by drilling mud which under higher pressure forms a filter cake on the fresh perforation opening. This can largely negate the advantages of the deeper penetration and larger hole size obtained by larger perforating guns.

Contrasted to a larger perforating gun and a positive pressure completion, a later developed method uses a through-tubing perforating gun which passes through tubing attached to a packer to a location below the packer. Through-tubing guns are smaller than the conventional casing guns and are typically fired in a negatively balanced well bore; that is to say, with the pressure in the casing and in the tubing being lower than the pressure in the surrounding earth formations. The through-tubing perforating gun is necessarily smaller and therefore does not produce the depth of penetration and hole size in an earth formation as compared to the conventional casing gun but does have higher shot density. Thus, while a through-tubing gun can achieve high effective shot density (shots per foot), reduced penetration and reduced hole size reduces the productivity which makes the technique unattractive for deep wells where high temperature, high pressure and hard formations exist. Also, with the throughtubing gun arrangement, well pressure control is a source of concern because, upon firing of the gun, the entire length of the tubing string is subjected to an elevated pressure and the well is controlled only by means of wireline pressure control equipment at the surface. Further, where negative differential pressure is employed to effect good perforation cleanup by reverse or back flow from the perforations to the casing, low permeability formations require a very high negative differential pressure to clean up the perforations, especially when gas is the produced fluid. Thus, when a high negative differential pressure is required for cleaning up the perforations there is a hazard of blowing the gun and its supporting cable up the casing which can result in the gun and cable becoming fixed or jammed in the well. This then requires an expensive fishing operation or, much worse, the well may have to be killed by high pressure control fluids which can possibly permanently damage the formations.

Another completion technique is when a tubing string carries a large, high performance gun below the packer and the gun fired after setting the packer and providing negative pressure in the tubing. While this system provides large gun performance and deep perforations and prevents blowing the gun and a cable up the hole, the tubing string is subjected to sudden large increases in pressure with the possibility of failure and loss of control of the well. Moreover, in the event a gun misfires, the entire tubing, packer and gun assembly must be withdrawn with subsequent significant increases in time and cost.

The method and apparatus of the present invention preferably employ a negative pressure technique for perforating and provide a means for safely maintaining well control with a full head of hydrostatic fluid or positive pressure above the perforated zone. In this system a way is provided to isolate the perforated zone at negative pressure from the hydrostatic fluid at positive pressure to induce back flow into the wellbore immediately upon perforating. The negative pressure and back flow from the perforations cleans the newly formed holes by expelling perforating gun debris and formation debris from the perforations rather than leaving such debris in the perforations and permitting invasion by drilling mud at a positive pressure.

The present invention results in higher productivity than with the through-tubing perforation guns because larger perforating guns can be run below a packer on a tubing and, when operated in conjunction with a PBR (polished bore receptacle) the gun can be even larger than when using a packer on a tubing. Further, the apparatus of the present invention minimizes the problem of debris plugging the perforations in that high negative differential pressures across the perforation can be used with positive differential pressure in the tubing string which eliminates adverse pressure effects such as creating sudden and excessive surface pressure on the wireline control or surface equipment and eliminates the risk of blowing the gun and its support cable up the casing or tubing. The present method enjoys the additional advantage of providing full well control at all times, i.e., if for any reason the packer on the tubing should fail at or after firing of the perforating gun, there is sufficient fluid above the packer at a positive pressure to kill the well should that be required. Thus, the apparatus and method of the present invention permits use of higher performance guns while maintaining well control throughout the perforating activity.

DESCRIPTION OF THE PREFERRED EMBODIMENT

Figure 1:
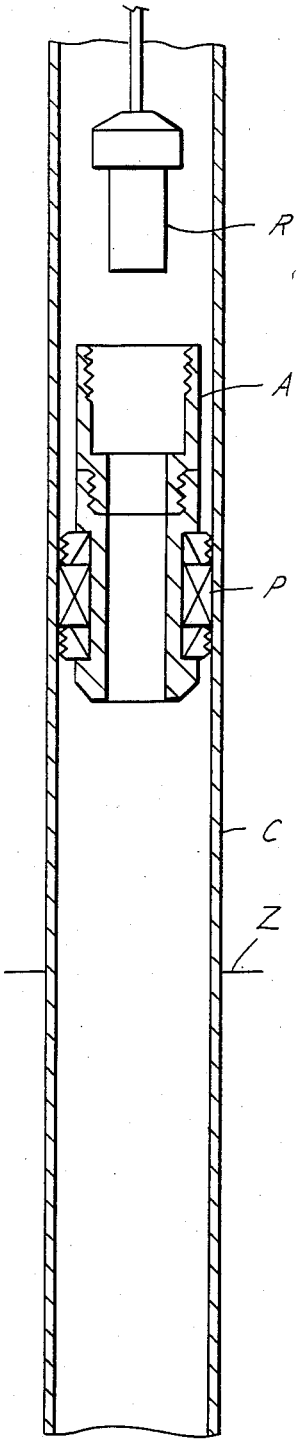
FIG. 1 is a schematic view illustrating a wireline packer setting tool and a packer and packer adapter sleeve assembly disposed in a string of casing which traverses earth formations.

As shown in FIG. 1 of the drawings, a conventional running tool R is used to position a packer adapter A and a production packer P at a desired location in a well casing. The production packer P typically has a large, open bore and is adapted to be permanently set in a casing C where an elastomer packing element seals against the bore of the casing and upper and lower slips hold the packing element in a sealing condition. The production packer typically is lowered through the casing to a desired location by use of an electric armored cable connected to a setting tool and casing collar locator. The casing collar locator provides a log at the surface of the earth of casing collars for depth correlation and location of the packer with respect to either a prior obtained radiation or collar log. The packer is set in the casing at a predetermined distance above the prospective pay zone or earth formations which are indicated by the letter Z.

Figure 2:
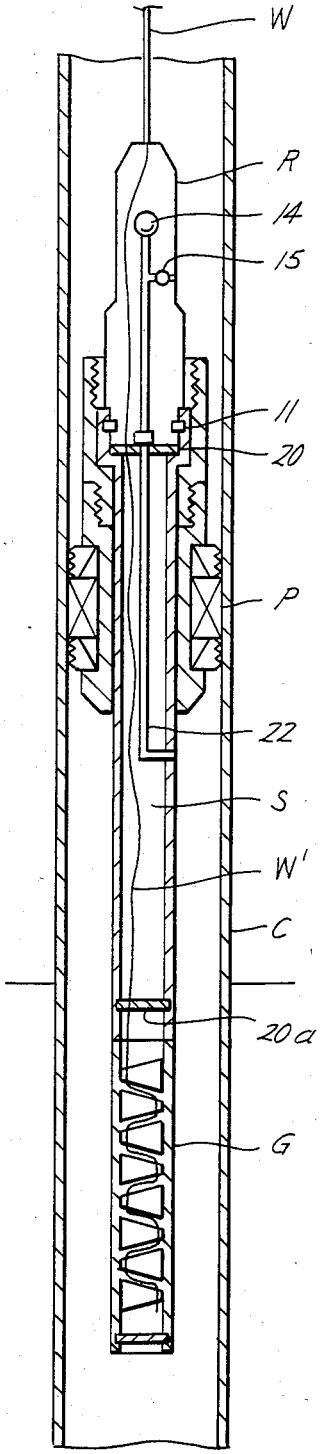
FIG. 2 is a schematic view partly in section and partly in elevation illustrating a running tool, a perforating gun and a pressure surge chamber disposed in place in the packer adapter sleeve of FIG. 1.

After setting the packer P and removing the running tool R from the casing, a system or perforating assembly including a perforation gun G, and a pressure surge chamber S are lowered into the casing by a running tool R on an armored cable W. FIG. 2 illustrates the system or perforating assembly disposed in a seated position in the open bore of a packer adapter or receptacle A of a set packer P.

The perforating assembly which includes the perforating gun G and the surge chamber S are releasably connected to the running tool R by means of releasable latch dogs 11 which interconnect the running tool R to the upper end of the surge chamber S. The running tool R includes a pressure gauge 14 which transmits a pressure responsive electrical signal to the earth's surface via the armored cable W. The pressure gauge 14 is connected by a flow conduit 22 that extends through a closure means 20, and through the surge chamber S to open to fluid communication with the annulus between the surge chamber and casing at a location 22' below the packer P when the surge chamber is seated in the packer adapter. A check valve or bypass valve 15 is provided in the tube 22 near the upper end of the running tool T to permit fluid from the location 22' to the upper opening 22''. The bypass valve 15 also permits fluid flow from below the packer to the casing at a location above the packer as the perforating gun and surge chamber enter into the bore of the packer adapter. The conduit 22 and the pressure gauge 14 provide means for obtaining a pressure test of the integrity of the seal of the packer and the perforating assembly. This test is obtained after the perforating assembly is seated in the packer adapter A by applying pressure to the fluid in the casing above the packer P from the earth's surface. If the perforating assembly is properly engaged or seated in the packer adapter A and there are seal leaks of the packer or of the perforating assembly, the pressure gauge 14 will not properly reflect the increased pressure above the packer P.

The surge chamber S includes a longitudinally extending tubular member which has closed ends which form a chamber. The pressure surge chamber is filled at the earth's surface with a gas to a predetermined pressure or may contain air at atmospheric pressure. The predetermined pressure in the chamber is determined by factors such as strength of the tubular member, the volume of the closed surge chamber, the amount of explosive pressure developed by the perforating gun upon detonation, and the desired down hole pressure in the chamber relative to the expected pressure of the earth formations. As will be explained hereafter the purpose of the surge chamber is to provide a negative pressure condition below the packer with respect to the pressure in the earth formations. The running tool T is supported on the armored cable W and includes the shooting wire W' which extends through the surge chamber S and is connected to a detonator for the shaped charges in the perforating gun G.

The perforating gun employs shaped charges which can be disposed in a tubular housing or separate capsule charges or another type of perforating device.

The surge chamber S is defined between the upper removable closure means 20 and the lower closure means 20*a*. Where a fluid tight housing is used to enclose the shaped charges, the lower end of the gun housing can define an end of the chamber and the closure means 20*a* is not necessary in this event. As shown in FIG. 2, the removable closure means 20 is a ceramic disk-type barrier. Also, as shown in FIG. 2, the closure means 20*a* may be a ceramic disk-type barrier valve or other suitable break valve.

Figure 2A:
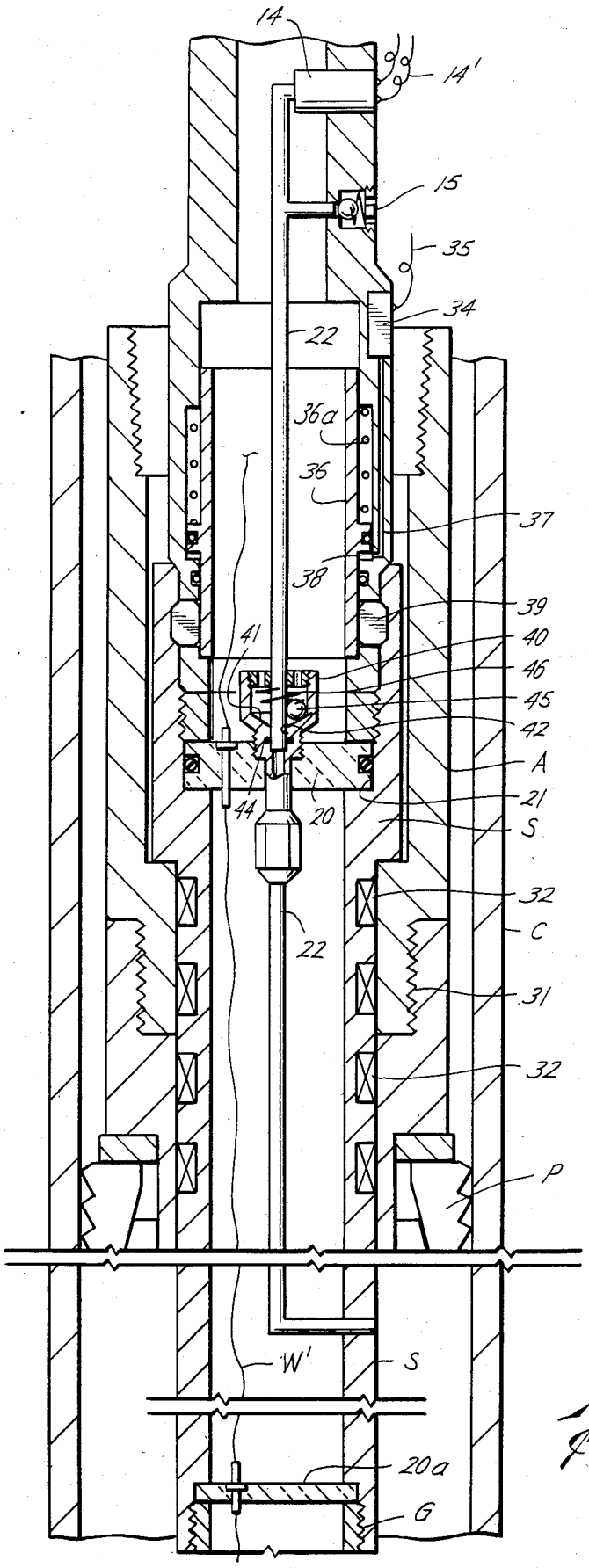
FIG. 2A is a sectional view illustrating details of means for connecting a running tool to a perforating gun.

Referring to FIG. 2A of the drawings, additional details of the running tool T and adapter sleeve A, as well as further details of the closure means 20 and means for connecting the bypass tube 22 to the surface reading pressure gauge 14 are illustrated. The adapter sleeve A is a tubular member which is threadedly attached to the upper tubular end of the packer body by a threaded connection 31. The adapter A has an upwardly facing shoulder formed by an enlarged bore so that a downwardly facing shoulder on the body of the surge chamber S can be seated on the upwardly facing shoulder in the adapter A and thereby interconnect the perforating gun and surge chamber with the adapter. Suitable seals 32 are provided on the body of the surge chamber S below the downwardly facing shoulder for sealing the body of the surge chamber S with respect to the adapter sleeve A. Thus, when the bore of the adapter A is closed, hydrostatic pressure in the casing above the surge chamber can be used to maintain the surge chamber S seated in the adapter A.

The running tool T includes the surface reading pressure gauge 14 which is provided with wire leads 14' which are connected to the cable and extend upwardly to the earth's surface. The pressure gauge 14 is connected by means of a tube or conduit 22 to an opening 22' between the closure means 20, 20*a* so that it will be below the packer when the assembly is seated in the adapter A. A one-way check valve 15 in the conduit 22 communicates with the fluid below the packer to the fluid above the packer P.

The running tool T also includes a release solenoid operated valve 34 which is connected by a wire 35 to the earth's surface through the cable for electrically actuating the solenoid valve. When the solenoid valve 34 is actuated it moves to an open position to permit fluid to be pumped under pressure from the casing above the packer and to flow through the conduit 37 into a running tool pressure chamber 38 to move a tubular sliding dog retaining sleeve 36 upwardly. Upward movement of the retaining sleeve 36 compresses a spring 36*a* and the retaining sleeve moves from a position beneath the latch dogs 39 to a position above the latch dogs 39 so that the latch dogs 39 are released from a locking groove in the surge chamber housing and thereby disconnect the running tool T from the upper end of the surge chamber S.

Figure 4:
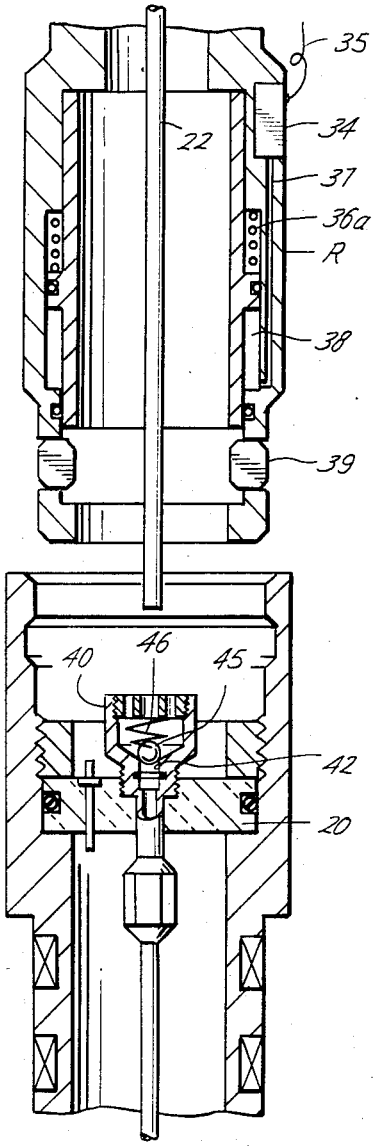
FIG. 4 is an enlarged view in cross section illustrating the running tool of FIG. 2A when it is disconnected from the perforating gun and the production valve is in a closed position.
Figure 5:
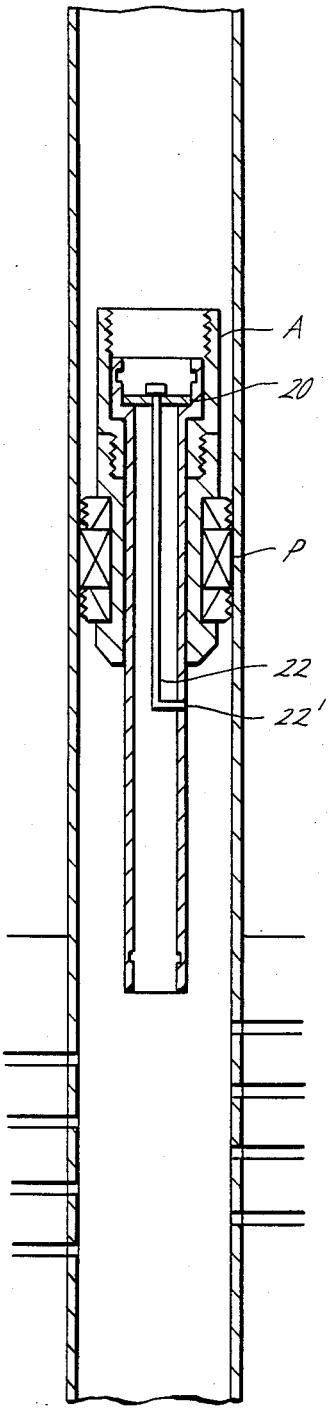
FIG. 5 is a schematic view illustrating the packer with a closed production valve after a perforating gun is operated.

Also, as shown in FIG. 2A a portion of the conduit 22 in the running tool T is slidably and sealingly received in a release valve 40 in the closure means 20. The release valve 40 includes an inwardly and downwardly tapered seat 41 around the central opening 42 which receives the end of a section of the conduit 22. O-ring seals 44 are provided in the opening 42 for sealing between the end of the section of the conduit 22 and the opening 42. Further, the valve 40 is threadedly and sealingly attached to the frangible ceramic disk 20. The disk 20 is sealed in a bore 21 of the body of the surge chamber by means of the O-ring seal 21*a*. When the end of the section of the conduit 22 is withdrawn from the bore 42 by release of the running tool T, a ball 45 positioned adjacent to the end of the conduit 22 rolls into position bridging or closing the opening 42. The ball 45 is urged to a closed position by means of a spring 46 which is mounted on the end of the section of the conduit 22. With this arrangement, the opening through the center of the valve 40 in the ceramic disk 20 is closed by the ball 45 so that the valve 40 acts as a check valve as shown in FIGS. 4 and 5 to isolate pressure in the casing above the packer P from pressure below the packer P. The section of the conduit 22 below the ceramic disk 20 is connected to the valve 40 and communicates through the opening 22' to the annulus between the surge chamber and the casing C. As shown in FIG. 2A, the passage opening 22' is positioned below the packer P when the surge chamber is seated in the adapter A. A second ceramic disk 20*a* is provided at the lower end of the surge chamber S.

Figure 3:
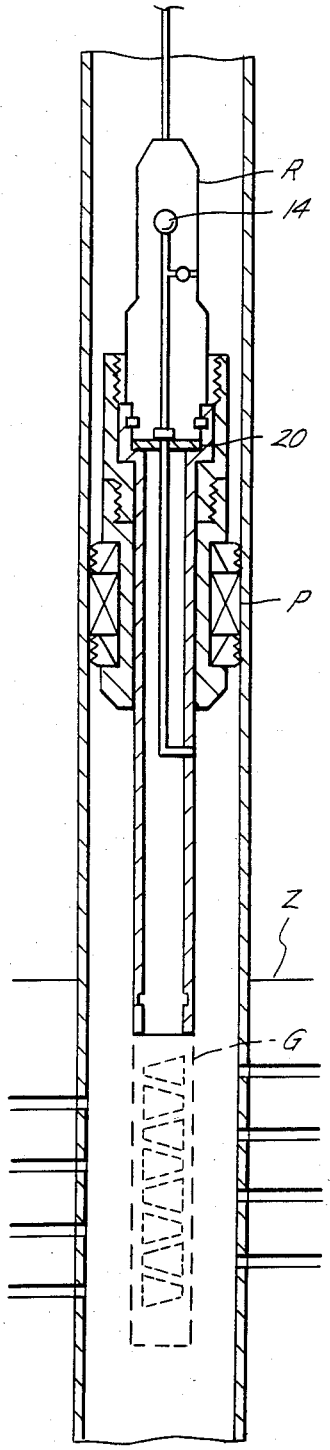
FIG. 3 is a schematic view, partly in section and partly in elevation, illustrating the apparatus of FIG. 2 after the perforating gun is operated.

As shown in FIG. 3, upon operation of the gun G, perforations are produced through the casing and into the earth formations while the gun disintegrates (shown in dashed lines). The disk 20*a* is disintegrated by the increased pressure caused by operation of the perforating gun so that at the time the gun is fired a negative pressure condition is introduced below the packer by the surge chamber. Fluid under pressure above the running tool T maintains the perforating assembly in a seated position in the adapter A and provides a positive pressure control for the well above the packer P. The removal of disk 20*a* places the interior of the surge chamber S and the gun tube (if a hollow carrier type) into communication with the wellbore below the packer P which produces a negative pressure below the packer. The pressure in the wellbore beneath the packer is sensed and recorded by the surface reading pressure gauge 14. Because of the negative pressure, formation fluids back flow from the earth formations thus cleaning the perforations. The flow from the formation continues until the volume of the surge chamber is accounted for and then a pressure buildup occurs below the packer. From the pressure buildup, the inflow capabilities of the perforated interval of the earth formations as well as the formation shut-in pressure can be determined. With this information a decision may be made whether to complete, treat or plug the perforated earth formation.

Figure 6:
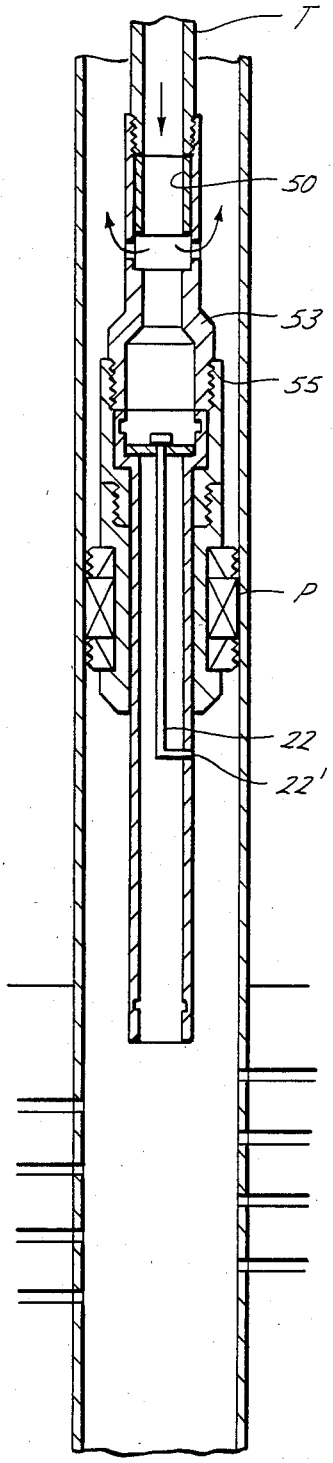
FIG. 6 is a schematic view illustrating a tubing string connected to a surge chamber with a circulating valve in an open position.

To complete the well, the running tool T is retrieved by releasing the dogs 39 from the surge chamber S and the completion zone Z remains isolated from the hydrostatic pressure of the well above the packer P by means of the valve 40 in the surge tool. This is best illustrated in FIGS. 4 and 5 of the drawings. The running tool T is retrieved. Thereafter, as shown in FIG. 6, to complete the well, a string of tubing T is run through the casing from the earth's surface with an open circulating valve 50. A seal and latch assembly 53 on the end of the tubing string is adapted to engage the upper open end of the adapter 55 and be mechanically secured to the surge chamber S in in the packer P. With the circulating valve open, completion fluid from the earth's surface may be circulated or reversed down through the tubing string and up the annulus between the tubing string and the casing, before or after engagement of the tubing string with the adapter A. The sliding sleeve 50 in the circulating valve is movable between open and closed positions. Circulation of the completion fluid displaces the mud in the tubing string and places the desired completion fluids in the string of tubing above the packer. Before removing the closure means 20, the tubing string may be pressure tested with the circulating valve 50 in a closed position and a permanent well head can be installed at the surface. The bottom hole pressure in the tubing at the packer can be adjusted with respect to the previously measured formation pressures to achieve either a balanced condition with respect to the pressure the tubing string. For example, if the string of tubing has a negative pressure with respect to the pressure below the packer when the closure means 20 is opened, it will produce a surge of formation fluid in the tubing. The closure means 20 may be a disk-type ceramic and either dissolved with acid or caustic or shattered by a go-devil dropped from the surface or by a knockout bar run on a wireline. If a plug type valve is used, it can be pumped out or pulled with piano or conductor line.

Figure 7:
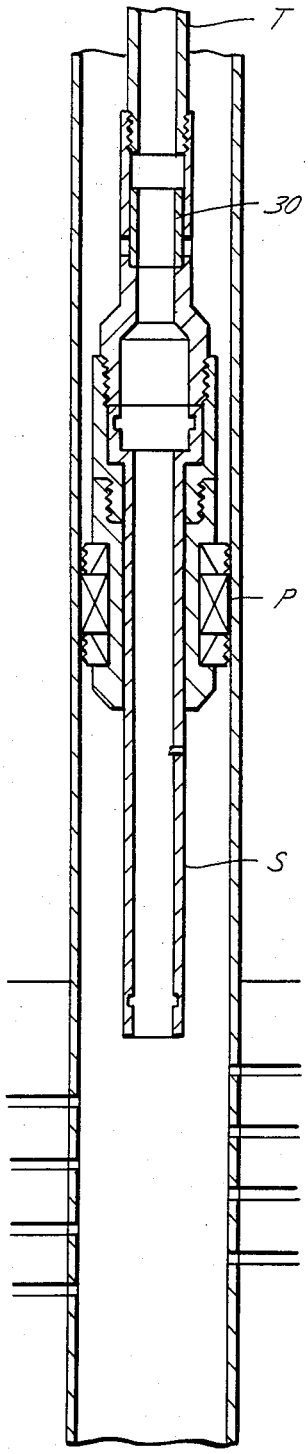
FIG. 7 is a schematic view illustrating a production tubing connected to a surge chamber with a production valve in an open condition and the circulating valve in a closed position.

As shown in FIG. 7 of the drawings, with the circulating valve 50 closed and the disk 20 (FIG. 6) removed, fluid may now flow from the perforations in the earth formations and through the surge chamber S up through the tubing T to the surface. With this system, the pay zone of the earth formations is separated from the wellbore casing above by the packer P so that optimum well control pressure conditions can be maintained and controlled during the initial flow period immediately after the perforating gun is fired and until the well is ready to put into production. Further, when the surge chamber S is opened upon the firing of the gun G its volume and pre-charge fluid pressure are calculated to produce the drawdown flow from the perforation need to induce cleanup flow from the perforations into the casing C. Further, the method and apparatus illustrated in FIGS. 1 through 7 permit analysis of the pressure of the producing zone isolated from the pressure of the fluid column above the packer in the casing while enjoying the speed, depth accuracy and safety of running explosive shaped charge devices with conductor line. It will be appreciated that the apparatus and method of the present invention are adaptable to steel tube hollow carrier, fully expendable, or semiexpendable perforating guns as well as tubular or fully expendable capsule type perforating guns. The packer P may be of a commercial large bore type allowing large diameter guns or a packer gun assembly with maximum gun diameter to be used. Also, it will be appreciated that the valve 40 separating the completion zone from the high hydrostatic pressure zone above the packer may be of a ruptured disk type with suitable electric connections to feed through the disk for gun firing and hydraulic pressure connections and measurement. Other valves such as a pumpout plug or wireline retrievable valve may also be used. With the method and apparatus of the present invention, well safety is assured by supporting a column of fluid above the packer P with sufficient positive hydrostatic pressure and volume to kill the well should that be required. Thus, a fail-safe condition is retained in the well until the production string is run and permanent wellhead is installed.

Figure 8:
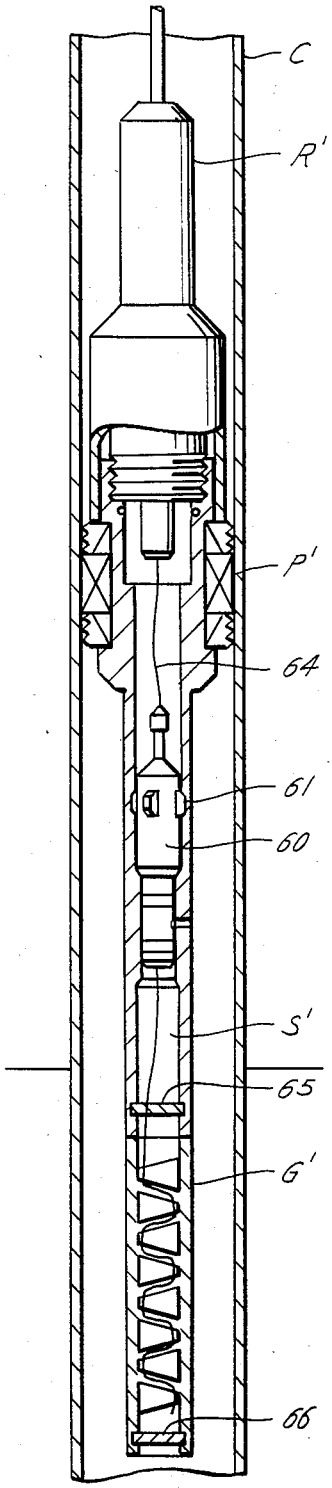
FIG. 8 is a schematic view of an alternate embodiment of the present invention utilizing a wireline retrievable plug valve in a tubing and located above the perforating gun and surge chamber.
Figure 9:
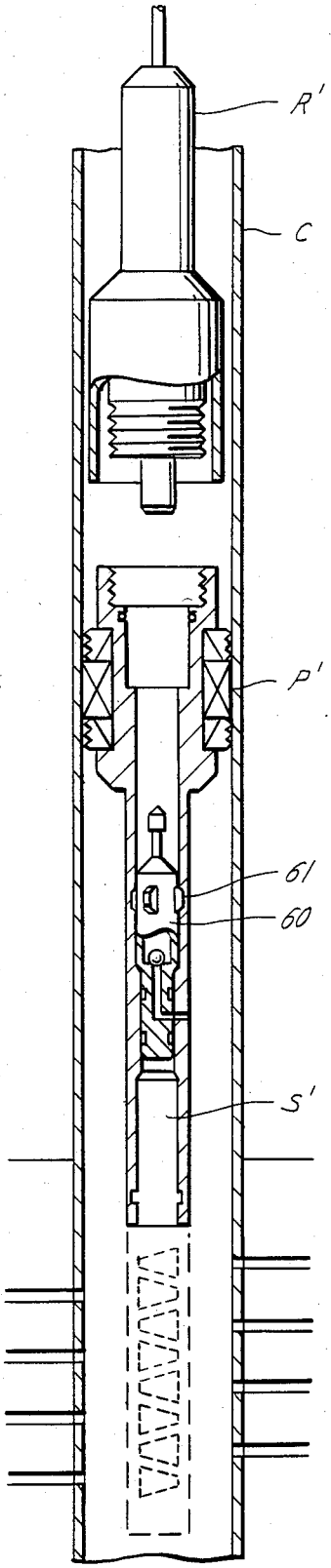
FIG. 9 is a view partly in section and partly in elevation, illustrating the running tool of FIG. 8 when disconnected from the upper end of the packer after firing of the perforating gun.
Figure 10:
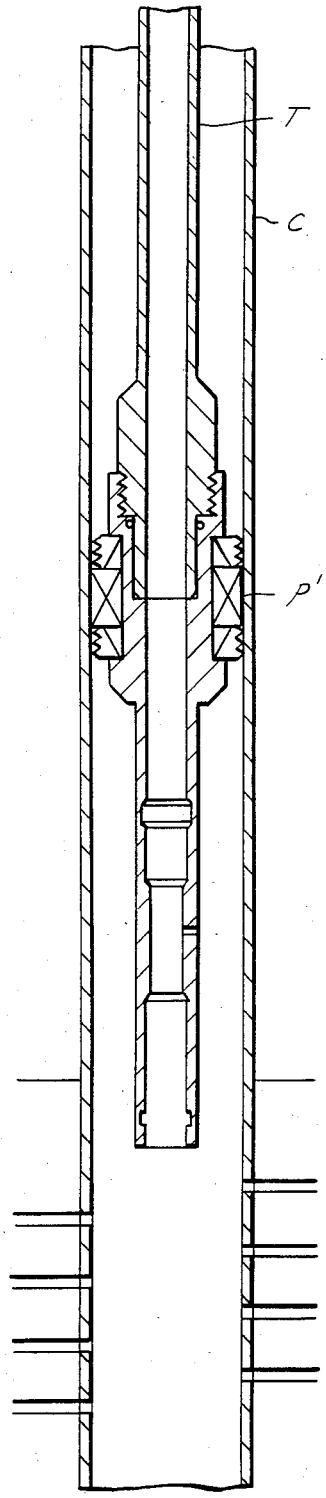
FIG. 10 is a view illustrating the apparatus of FIG. 9 after the plug valve is removed from the tubing and a tubing string is connected for production.

An alternate embodiment of the method and apparatus of the present invention is illustrated in FIGS. 8 through 10. In this embodiment, the packer P′ and the gun G′ can be operated on a single trip in the well. This is accomplished by connecting a surge chamber S′ and gun G′ to a wireline set packer P′. The setting tool R′ for the packer P′ includes a collar locator as well as a packer setting device so that the packer P′ may be set at a desired elevation or location with the attached surge chamber S′ and the gun G′ suspended beneath the packer and the running tool R′ positioned above the packer P′. In this embodiment, a retrievable plug valve 60 is secured by latch members 61 in a latching groove in the upper end of the surge chamber S′ and, as shown in the drawings, the necessary wire 64 for firing the gun G′ extends through the packer P′ and the surge chamber S′ and is suitably connected in the retrievable valve 60. As shown in FIG. 8 of the drawings, the entire assembly is lowered in position in the casing on the end of an electric cable so that the gun G′ is positioned adjacent the zone or earth formations to be perforated. The packer setting tool is actuated to set the packer in a sealing condition in the casing. The hydrostatic pressure in the casing above the packer is then adjusted to a positive pressure. Next, the gun is operated and upon firing of the gun, as illustrated in FIG. 9, the explosive actuated ceramic disk valve 65 (FIG. 8) at the lower end of the gas pre-charged surge chamber S′ as well as the explosive actuated ceramic disk valve 66 (FIG. 8) at the lower end of the perforating gun G′ are shattered so that the surge chamber S′ at a negative pressure condition and is in communication with the perforated formations. It will be appreciated that other suitable types of valves may be incorporated rather than frangible valves 65, 66, as shown. Pressure sensors in the retrievable valve 60 communicate pressure measurements to the surface reading pressure gauge (not shown) and the pressure below the valve 60 may thereby be monitored from the surface.

Should it be desired to complete the well, the running tool R′ is disconnected from the upper end of the surge chamber as shown in FIG. 9 of the drawings. Since the retrievable valve 60 remains latched in the upper end of the surge chamber, the positive pressure above the packer is isolated from the pressure of the earth formations below the packer P′. Thereafter, as shown in FIG. 10 of the drawings, a string of tubing is run from the surface and attached to the upper end of the surge chamber. The bottom hole pressure in the tubing T is adjusted to a desired value by a cirulating valve (not shown). The valve 60 (of FIG. 9) is then released and retrieved through tubing so that production flow is permitted through the tubing string.

Figure 11:
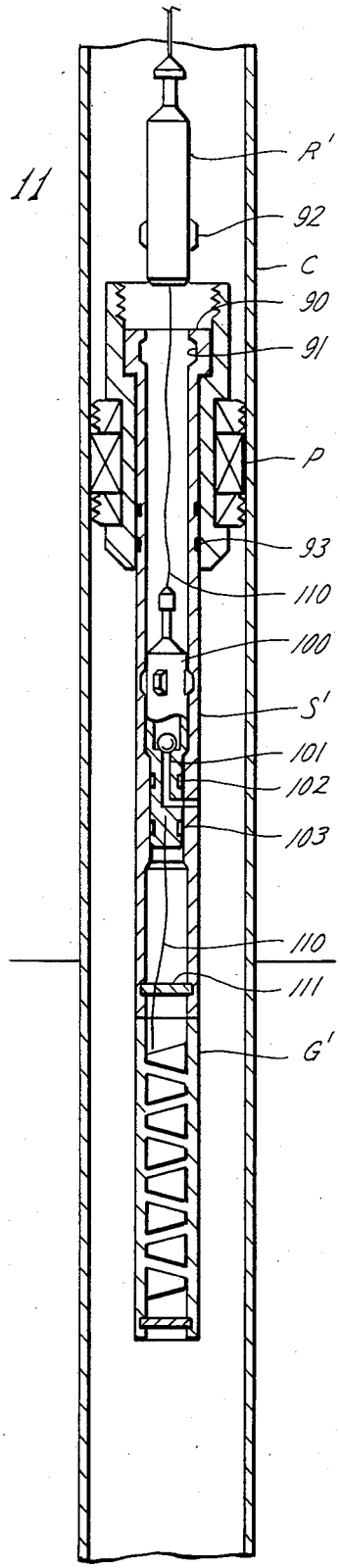
FIG. 11 is a schematic view of a different variation of the apparatus shown in FIG. 2 where a different type of valve is employed.

Another alternate embodiment of the method and apparatus of the present invention of the apparatus and method of FIGS. 1–7 is illustrated in FIG. 11. In FIG. 11 of the drawings, a pressure gauge is not utilized and the closure means is a plug valve. As shown in FIG. 11, a commercial wireline set packer P is set in the casing C at a desired elevation or location above the zone to be perforated. The surge chamber S′ is attached to a gun G′. The upper end of the body of the surge chamber S extends upwardly through the packer P and is provided with a downwardly facing shoulder 90 which engages an upwardly facing shoulder in the upper end of the body of the packer. The upper end of the body of the surge chamber S' includes an internal annular latching groove 91 for receiving the latch detents 92 in the wireline supported running tool R'. The body of the surge chamber S' is provided with suitable external seals 93 which seal the chamber S' in the central opening extending through the body of the packer P. A wireline retrievable valve 100 is modified with a bypass and check valve to compensate for gun volume. A bypass 101 permits fluid to flow from below packer through the check valve and to the body of the surge chamber above wireline retrievable valve 100. Also, as shown in FIG. 11 of the drawings, the wireline retrievable valve 100 is provided with upper and lower O-ring seals 102 and 103 which are positioned above and below, respectively, the bypass 101. Also, the wireline retrievable valve 100 includes the wiring connection for connecting an electrical firing wire 110 which extends through the explosive actuated ceramic disk 111 at the upper end of the gun G' to connect to the perforating gun G' which, in this embodiment, may be any desired type of perforating gun. The surge chamber S' is pre-charged with gas under a predetermined pressure between the lower end of the wireline retrievable valve 100 and the ceramic disk 111 to a desired pressure as described herebefore.

With this arrangement, after the packer P is set in sealing condition in the casing, the running tool R' is connected to the upper end of the body of the surge chamber S' by means of the detents 92 and the surge chamber S' and gun G' are lowered from the surface until the surge chamber seats in the preset packer P. The bypass and the check valve and the wireline valve 100 permit fluid beneath the packer to be displaced when the gun is inserted through the opening in the packer. With the gun in position, the pressure in the casing above the valve 100 is adjusted to a positive value. Then the gun is fired in the normal manner, the explosive actuated ceramic disk valve 111 opens the surge chamber S' at a negative pressure condition below the valve 100 to induce flow into the casing C beneath the packer P. Thereafter, the running tool R' can be released and retrieved with the wire 110 breaking or releasing with respect to the valve 100. Next the tubing string is connected to the packer similar to the operation as described with respect to FIG. 7. The completion fluid and pressure in the tubing string is adjusted as desired and the valve 100 removed to permit production.

Figure 12:
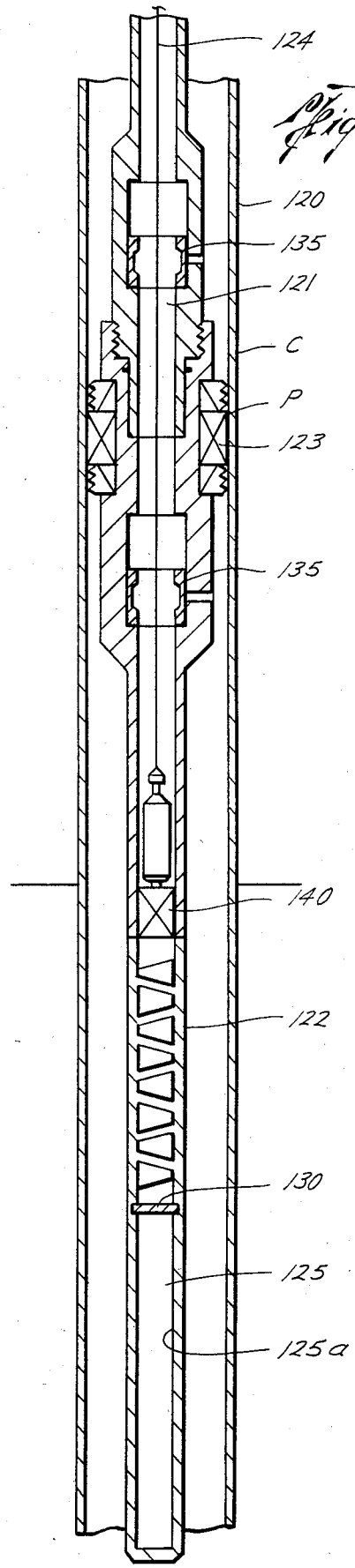
FIG. 12 is a schematic view of another form of the invention which utilizes a tubing conveyed perforation system with a surge chamber for accommodating a sudden increase in pressure upon firing the perforating gun.

FIG. 12 shows an alternate embodiment of the present invention wherein the casing 120 is in the wellbore and a string of tubing 121 supports a tubing conveyed perforating gun 122 attached below a packer 123. After the packer 123 is set in the casing, an electrical line 124 is run down the tubing string 124 to couple to the firing mechanism for the gun 122 for detonating the charges in the gun when desired and for coupling to a pressure gauge and barrier 140 above the gun G'. Below the perforating gun 122 is a surge chamber 125 for providing a negative pressure when the gun 122 is fired. The surge chamber 125 is separated from the perforating gun by a frangible disk 130 or other suitable means for opening the interior of the surge chamber 125 to pressure in the casing 120 below the packer 123 when the gun is fired. A circulating valve 135 is provided above the packer 123 for balancing the pressure of completion fluid in the tubing with respect to the hydrostatic head in the annulus between the casing and the tubing. The pressure gauge and barrier 140 is included in the tubing string to permit monitoring well pressure below the packer 123. The pressure in the tubing above the pressure gauge 140 provides for control of the formation pressure below the packer. After the firing of the gun 122 at the negative pressure balance below the packer P the pressure buildup is determined by the pressure measurements. To produce the well a sleeve shifting tool (not shown) is used on a wireline to open a vent valve **135*a*** and the well can then be produced through the tubing.

It will be appreciated that with the method and apparatus of the present invention a completion method is provided for utilizing wireline and tubing conveyed perforating guns below a packer to perforate a zone which has been isolated from the hydrostatic pressure of the fluid column above the packer and yet which has available a fluid column under positive pressure to counteract a blowout should unexpected high pressure in a formation be encountered. Further, with the method and apparatus of the present invention the fluid pressure in the isolated zone below the packer may be monitored after perforating to aid in making a determination as to whether to go forward with the completion efforts or to treat the well or alternatively, to plug it.

It will be appreciated that this method can also be used to complete the well with heavy fluid or desired fluid in the tubing string to maintain well control as desired. That further, the effect of a back surge on the perforations is achieved. After the well has been perforated, and the formation pressures established, the completion fluid in the tubing can be adjusted to a desired level and the vent valve **135*a*** can be opened, allowing the well to be produced.

This method can also be used where the perforating gun is fired by means of a go-devil. Though the desired control of the well is achieved, the ability to read the pressure at the surface would be lost.

This method can also be applied to guns that are run through large bore packers or polished bore receptacles (PBR).

Figure 13:
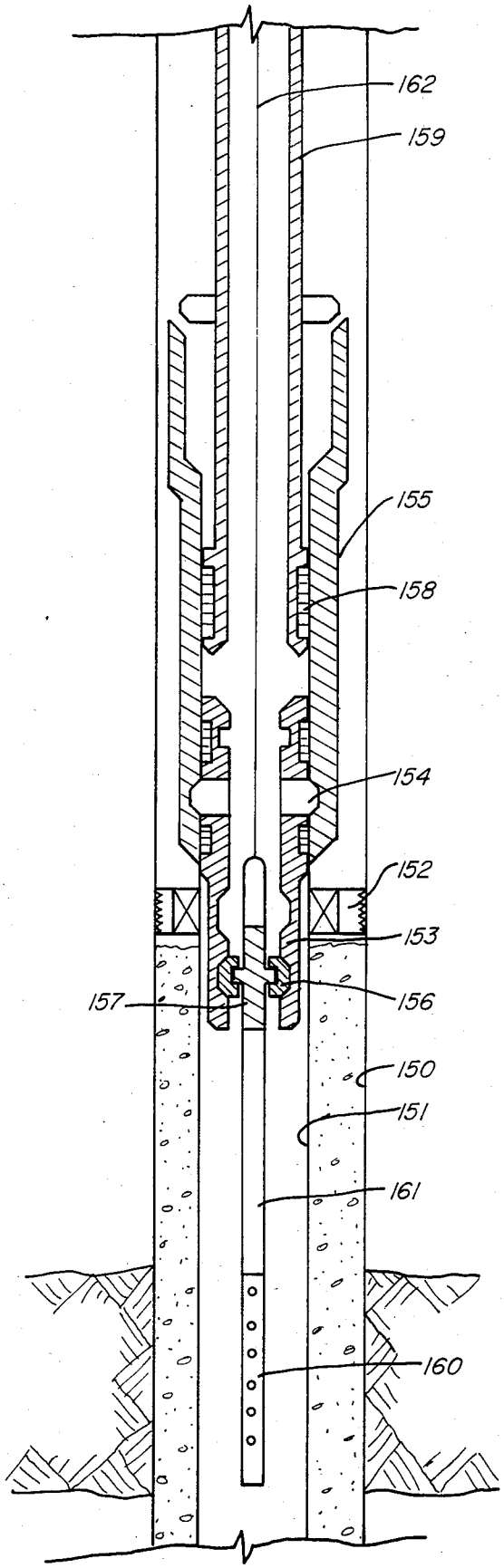
FIG. 13 is a schematic view of another form of the invention which is utilized in a packer bore receptacle.

Referring now to FIG. 13, a well casing 150 traversing earth formations is illustrated. A liner 151 is hung in the lower end of the casing 150 by a liner hanger 152 and the annulus between the liner 151 and the casing 150 or borehole is cemented in a well known manner. Above the liner hanger 152 is a retrievable landing assembly 153 which is releasably latched by latching lugs 154 in a latching groove in the packer bore receptacle 155. In this tubular system, the landing assembly 153 is adapted to receive a latching means 156 for releasably receiving a landing plug 157 which closes off the bore through the landing assembly. The landing assembly 153 is sealed with respect to the bore of the packer bore receptacle 155 above and below the latching lugs 152. The bore of the packer bore receptacle 155 above the latching lugs 154 slidably and sealingly receives a seal assembly 158 on the lower end of a string of tubing 159.

There are a number of options with the use of PBR systems. As shown in FIG. 13, the perforating gun 160, surge chamber 161 and landing plug 157 may be positioned by an armored cable 162 to lock into the landing plug 156. Thereafter, the operation may be conducted with the use of the surge chamber !61 for negative pressure while maintaining positive fluid pressure above the landing plug 157. Upon retrieval of the plug 157 the well can be completed as described heretofore.

Alternatively, the retrievable landing assembly 153 can be removed so that the gun 160 and surge chamber 161 can be diametrically enlarged and the grooves 154 can be used to releasably latch a gun, surge chamber and plug in the packer bore receptacle 155. This then permits use of higher performance guns either on tubing or wire line where positive pressure control exists in the pipe above a closure member and a negative pressure condition is presented below the closure member upon firing of the perforator.

Figure 16:
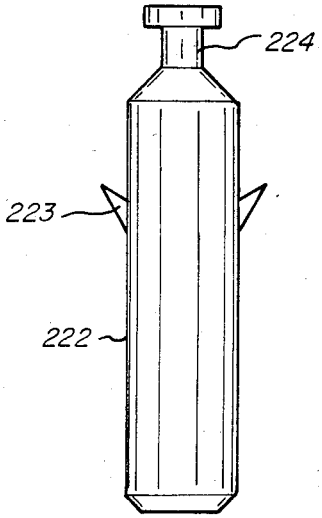
FIG. 16 is a view of a dropping bar for use with the apparatus of FIGS. 14 and 15.
Figure 15:
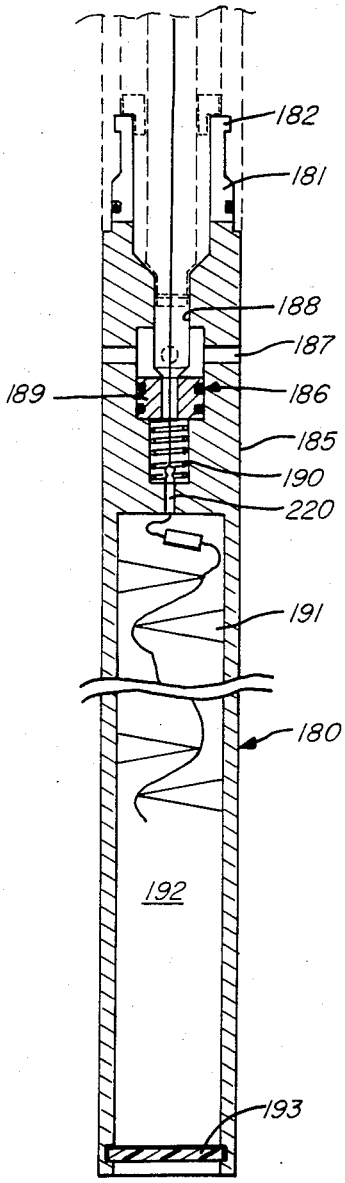

Referring now to FIGS. 15 and 16, another system variation is illustrated. In FIG. 15, a conventional packer 170 is permanently set in a well casing 170 at a selected location above the zone of earth formations to be perforated. Details of the packer 170 are not illustrated. The packer 170 has an upwardly extending attached polished bore receptacle 172 having a bore 173 which slidably and sealingly receives a tubular housing 174. The tubular housing 174 at its upper end has a conventional latching assembly 175 for latching to the receptacle 172 and an upper sealing bore 176. The housing 174 shown below the packer 170 has a vent valve 177 which is shown with a sliding sleeve 178 in a closed position. Below the vent valve 177, the housing 174 has a latch sleeve 179 which is shown in a lowermost position.

A perforating gun and surge chamber assembly 180 is releasably attached to the lower end of the housing 174 by latch fingers 181 which have latching detents 182 received in an annular latch groove 183 in the housing 174. The detents 182 are formed by circumferentially spaced longitudinal slots which permit the detents to flex inwardly. The detents 182 are releasably held in the groove 183 by the latch sleeve 179. Thus the housing 174 is latachable into the receptacle 172 and releasably carries the gun and surge chamber assembly 180 at its lower end.

As shown in FIG. 15, the gun and surge chamber assembly 180 include a housing 185 which has a vent valve 186 at its upper end. The vent valve 186 includes side ports 187 opening to the exterior of the housing 185 and to a central bore 188 and a sleeve valve 189 which is shown in an open position and compressing a spring 190. Below the vent valve 186, the housing 185 contains shaped charges 191 and below the shaped charges is a surge chamber 192. The lower end of the surge chamber 192 is closed with a frangible ceramic disk 193. The interior of the chamber 192 and the housing portion containing the shaped charges is at a predetermined low pressure to provide the negative balanced pressure when the shaped charges 191 are detonated.

Figure 14:
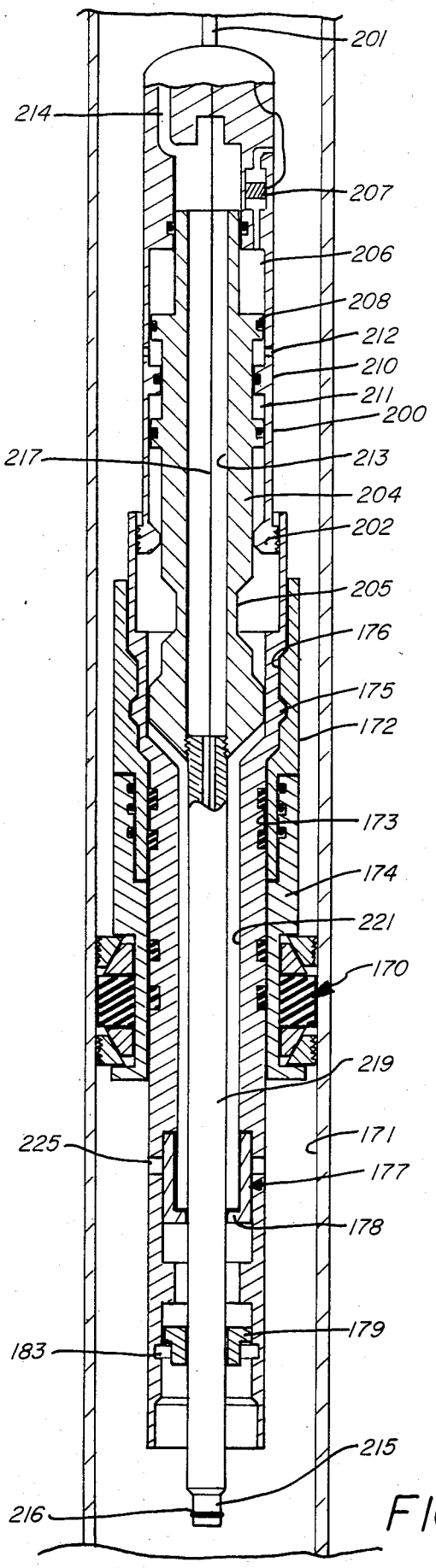
FIG. 14 and FIG. 15 are schematic illustrations of an assembly for use of the invention with a polished bore receptacle.

Referring again to FIG. 14, a running tool 200 is connected to a armored cable 201 (sometimes called a wireline). The tool 200 has latching members 202 which releasably attach to the upper inner end of the housing 174. The latching members 202 are held in a latching position by the outer surface of a mandrel 204. Grooves 205 on the mandrel 204 are adapted to be shifted to a position under the latching members 202 to release the tool 200 from the housing 174. Shifting of the mandrel 204 is accomplished by releasing a trapped fluid 206 in a chamber. The fluid 206 is released by an electrical signal which detonates an explosive and opens a break valve 207 so that fluid 206 has access to the exterior of the tool 200. Pressure from fluid in the casing is applied to a piston 208 through ports 212 in the housing 210 and opening the valve 207 moves the mandrel 204 upwardly relative to the housing 210 to release the latch members 202. A surge chamber 211 can be provided below the piston 208.

The mandrel 204 has a central bore 213 which is in communication with a flow passage 214 to a pressure sensor (not shown) in the upper end of the housing. The pressure sensor is responsive to pressure to provide an electrical signal representation of the pressure measurement for transmission to the earth's surface on the cable 201. At the lower end of the mandrel 204, a pipe member 219 extends downward through the housing 174 and has an end portion 215 with an external seal 216. The end portion 215 and seal 216 are received in the bore 188 of the gun and chamber assembly 180 and normally retain the sleeve valve 189 in an open position. A shooting wire 217 extends from the cable 201 through the mandrel bore 213 and pipe member 219 to a sealed connector 220 on the gun to couple a cable wire to the detonator for the shaped charges 191.

In operation, the gun and surge chamber assembly 180 are connected by the latch detents 182 to the housing 174. The housing 174 is connected by the latch member 202 to the running tool 200. After the packer 170 and polished bore receptacle (PBR) 172 are set in the casing the interconnected assemblies are lowered by the cable 201 into the PBR 172. At this time the fluid in the casing above the packer 170 is isolated from the fluid in the casing below the packer 170. Pressure from below the packer 170 is admitted via ports 187 in the gun housing 185 to the bore through the pipe 219 and mandrel 204 to the pressure sensor in the housing 210. The pressure above the packer 170 is adjusted to provide a positive pressure with respect to the pressure in the earth formations. Next, the shaped charges 191 are fired to produce perforations through the casing and into the earth formations. The explosive forces generated break the disc 193 and the formations are at a negatively balanced pressure because of the surge chamber 192. This permits a back flush of the formations by formation fluids under pressure and the pressure is sensed during the back flush and until the formation pressure builds up under the packer 170.

If the well is to be completed, the break valve 207 is operated to release the latch members 202 from the housing 174 by moving the mandrel 204 upwardly. Upward movement of the pipe 219 releases the holding force on the sleeve valve 187 which moves to a position closing off the ports 187. The setting tool 200 is then retrieved while the control pressure is maintained above the packer 170.

Next a string of tubing is lowered into the tubing and latched to the latch grooves in the upper end of the housing 174 with a sealing assembly to seal the tubing string with respect to the housing 174. The bore 221 through the housing 174 is sized to the base of the tubing string so that a bar 222 (FIG. 16) can be dropped through the tubing string after the tubing string is connected to the housing 174. The bore 222 has fingers 223 which are arranged to engage the inner lugs on the sleeve 178 and move to the sleeve 178 to a position opening the ports 225 to admit fluid in the casing to the tubing string so that flow through the tubing string is established. As discussed before, the tubing string can contain completion fluid reversed into position by a circulating valve in the string of tubing. The bar 222 after moving the sleeve 178 passes through the sleeve 178 and bottoms in the top of the gun housing 185 with its fingers 223 located below the inwardly extending lugs on the sleeve 179. The well can be produced through the valve 177. Alternatively, a wireline grapple can be lowered through the string of tubing to engage a fishing neck 224 on the bar. When the bar 222 is moved upwardly, the fingers 223 engage the sleeve lugs and move the sleeve 178 from a locking position so that the gun and chamber assembly 180 is freed with respect to the housing 174 and can drop to the bottom of the casing leaving a full bore through the housing 174 and string of tubing for increased production. This system permits the use of larger perforating guns which can pass through the bore of the PBR 174.

The foregoing disclosure and description of the invention are illustrative and explanatory thereof, and various changes in the size, shape and materials, as well as in the details of the illustrated construction may be made without departing from the spirit of the invention.

I claim:

1. A wireline operated well perforating apparatus adapted to be positioned below a packer mounted in a wellbore comprising:

(a) a running tool adapted to be supported on a wireline;

(b) a pressurized surge tank operably connected to said running tool;

(c) means for supporting a perforating gun on said surge tank and means for selectively opening communication between said surge tank and said wellbore to reduce pressure in said wellbore adjacent said surge tank; and (d) frangible valve means in the upper end of said surge tank to close communication between pressure from well fluid above said surge tank and pressure in said wellbore below said surge tank.

2. The invention of claim 1 including pressure sensing means for sensing pressure in said wellbore below said surge tank.

3. The invention of claim 2 including pressure indicator means at the surface of the well to indicate pressure in said wellbore below the surge tank.

4. The invention of claim 2 wherein said pressure sensing means includes a bypass conduit extending through said frangible valve and check valve means in said frangible valve for receiving said bypass conduit and for closing communication through said frangible valve when said bypass conduit is removed therefrom.

5. The invention of claim 4 including check valve means in association with said bypass conduit for allowing displacement of well fluid below the packer as said surge tank and perforating gun are lowered through said packer.

6. The invention of claim 1 including frangible disk means at the lower end of said surge tank adapted to be broken when said perforating gun is fired.

7. The invention of claim 1 including frangible valve means of said surge tank and frangible valve means at the lower end of said perforating gun, which frangible valves are adapted to be shattered upon firing of said perforating gun to thereby open communication through said perforating gun and said surge tank thereof, and retrievable plug valve means in the upper end of said surge tank to close communication between well fluid thereabove and well fluid therebelow.

8. The invention of claim 7 including means for retrieving said retrievable plug valve after a tubing string has been secured to said surge tank to permit fluid flow through said packer into the tubing string.

9. The invention of claim 7 including pressure sensing means for sensing pressure in said wellbore below said surge tank and perforating gun.

10. The invention of claim 9 including indicator means at the surface of the well to indicate pressure in said wellbore sensed by said sensing means.

11. An apparatus for reducing a surge of pressure in a wellbore from firing a perforating gun therein comprising:

support means adapted to be suspended in a wellbore, tank means having pressurized surge chamber means therein for reducing a pressure surge in the wellbore from firing a perforating gun; and frangible valve means in the upper end of said surge tank to close communication between pressure from well fluid above said surge tank and pressure in said wellbore below said surge tank.

12. A method for completing earth formations traversed by a well casing comprising the steps of:

setting a production packer in a well casing at a location above an earth formation to be perforated where the production packer has a central opening;

lowering a wireline tool releasably connected to a tubular member having a closed bore and sealingly disposing the tubular member in the central opening of the production packer where the tubular member carries a low pressure surge means and perforating means so as to dispose the low pressure surge means and perforating means below the production packer;

firing said perforating means and opening said pressure surge means so as to place the earth formation in fluid communication with the well casing below the production packer with a negative balanced pressure in the well casing;

and maintaining well control pressure above the closed bore in the tubular member above the pressure expected from the earth formations.

13. The method as set forth in claim 12 and further including the step of sensing the pressure in the well casing below the production packer and transmitting the pressure parameter sensed as a function of an electrical signal to the earth's surface.

14. The method as set forth in claim 12 and further including the step of releasing and retrieving the wireline tool from the well casing while maintaining the well control pressure above the production packer.

15. The method as set forth in claim 14 and further including the step of running a string of tubing in the well casing and interconnecting the string of tubing with the production packer.

16. The method as set forth in claim 15 and further including the step of opening the closed bore in the tubular member for placing the fluids in the well casing below the production packer in fluid communication with the string of tubing.

17. The method as set forth in claim 12 and further including the step of releasing and retrieving the wireline tool from the well casing while maintaining the well control pressure above the production packer.

18. The method as set forth in claim 17 and further including the step of running a string of tubing in the well casing and interconnecting the string of tubing with the production packer.

19. The method as set forth in claim 18 and further including the step of opening the closed bore in the tubular member for placing the fluids in the well casing below the production packer in fluid communication with the string of tubing.

20. The method as set forth in claim 17 and further including the step of running a string of tubing in the well casing and interconnecting the string of tubing with the production packer.

21. The method as set forth in claim 20 and further including the step of retrieving the plug member and opening the closed bore in the packer for placing the fluids in the well casing below the production packer in fluid communication with the string of tubing.

22. A method for completing earth formations traversed by a well casing comprising the steps of:

lowering a wireline tool releasably connected to a production packer having a closed bore into a well bore to a preselected depth where the packer also dependingly carries a low pressure surge means and perforating means so that the low pressure surge means and perforating means are below the production packer, and the low pressure surge means has a bore with a releasable plug member therein;

setting the production packer in a well casing at a location above an earth formation to be perforated;

firing said perforating means and opening said pressure surge means so as to place the earth formation in fluid communication with the well casing below the production packer with a negative balanced pressure in the well casing;

maintaining well control pressure above the plug member in the closed bore above the pressure expected from the earth formations.

23. The method as set forth in claim 22 and further including the step of releasing and retrieving the wireline tool from the well casing while maintaining the well control pressure above the production packer.

24. A method for completing earth formations traversed by a well casing where the well casing contains an open bore receptacle, comprising the steps of:

lowering a wireline tool releasably connected to a tubular member having a closed bore and sealingly disposing the tubular member in an open bore receptacle where the tubular member carries a low pressure surge means and perforating means so as to dispose the low pressure surge means and perforating means below the open bore receptacle;

firing said perforating means and opening said pressure surge means so as to place the earth formation in fluid communication with the well casing below the open bore receptacle with a negative balanced pressure in the well casing; maintaining well control presure above the closed bore in the tubular member above the pressure expected from the earth formation.

25. The method as set forth in claim 24 and further including the step of sensing the pressure in the well casing below the production packer and transmitting the pressure parameter sensed as a function of an electrical signal to the earth's surface.

26. The method as set forth in claim 25 and further including the step of releasing and retrieving the wireline tool from the well casing while maintaining the well control pressure above the open bore receptacle.

27. The method as set forth in claim 26 and further including the step of opening the closed bore in the tubular member for placing the fluids in the well casing below the open bore receptacle in fluid communication with the string of tubing.

28. The method as set forth in claim 24 and further including the step of releasing and retrieving the wireline tool from the well casing while maintaining the well control pressure above the open bore receptacle.

29. The method as set forth in claim 28 and further including the step of running a string of tubing in the well casing and interconnecting the string of tubing with the open bore receptacle.

30. The method as set forth in claim 29 and further including the step of opening the closed bore in the tubular member for placing the fluids in the well casing below the open bore receptacle in fluid communication with the string of tubing.

31. The method of completing a well comprising:

setting a packer in the well bore at a desired distance above the zone to be perforated, running a retrievable running tool having a pressurized surge tank and a perforating gun connected thereto and adapted to extend below said packer until the running tool reaches said packer and said perforating gun is below said packer, actuating said perforating gun to perforate the well bore below said packer, disconnecting the running tool from the surge tank and perforating gun, retrieving said retrievable running tool, running a string of tubing and landing the lower end of same in the upper end of said surge tank and rupturing a frangible disk in the upper end of said surge tank to open communication therethrough to receive fluid from below said packer.

32. The method of completing a well comprising:

(a) running a retrievable running tool having a packer mounted thereon and a surge tank and perforating gun therebelow with a retrievable plug valve in the upper end of said surge tank and with a frangible disk valves between said surge tank and said perforating gun and at the lower end of said perforating gun which are adapted to be shattered upon actuation of said perforating gun;

(b) setting the packer in the well at a desired distance above the zone to be completed;

(c) actuating said perforating gun to perforate the well;

(d) retrieving said retrievable running tool;

(e) running a string of tubing into the well and connecting the lower end of such tubing string in the upper end of the surge tank; and (f) retrieving said retrievable plug valve to open communication through the perforating gun, the surge tank and into the string of tubing.

33. Perforating apparatus for use in the completion of oil wells in cooperation with an open bore receptacle means located in a well casing which traverses earth formation, comprising:

perforating means for providing fluid communication channels between the well casing and surrounding earth formations, said perforating means being adapted for interconnection with open bore receptacle means in a well casing so as to be disposed below the open bore receptacle means when situated in a well casing;

pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

means responsive to the operation of said perforating means for opening said elongated chamber to the well casing below the open bore receptacle means; and closure means for isolating the pressure surge means and perforating means with respect to the open bore receptacle means so that the pressure in the well casing above an open bore receptacle means can be controlled independently of the pressure in the well casing below an open bore receptacle means thereby permitting well control by use of sufficient fluid pressure above an open bore receptacle means while permitting flow of fluid from the earth formations into the well casing at a negatively balanced pressure so as to enhance clean-up of the fluid communication channels produced in the earth formations by operation of the perforating means while maintaining control of the well.

34. The apparatus as defined in claim 33 wherein said perforating means and said pressure surge means are interconnected to an upper tubular section which is sized and constructed to be slidably and sealingly received in an open bore receptacle means.

35. The apparatus as defined in claim 33 wherein said tubular section includes means for releasably receiving a releasable plug member, and a releasable plug member constructed to be releasably received in said tubular section for sealing off the bore of said tubular section.

36. The apparatus as defined in claim 35 wherein said plug member and tubular section have pressure relief valve means.

37. The apparatus as defined in claim 36 and further including releasable valve means disposed at between the plug member and perforating means for isolating said pressure surge means from said perforating means and are operable upon firing of said perforating means for opening said pressure surge means to the well casing.

38. The apparatus as defined in claim 37 and further including additional releasable valve means where said releasable valve means enclosing said perforating means and are operable upon firing of said perforating means for opening said perforating means to the well casing.

39. The apparatus as defined in claim 33 wherein said perforating means and said pressure surge means are adapted to be interconnected to an open bore receptacle means.

40. Perforating apparatus for use in completion of oil wells in cooperation with an open bore receptacle means located in a well casing which traverses earth formation, comprising:

perforating means for providing fluid communication channels between the well casing and surrounding earth formations, said perforating means being adapted for interconnection with open bore receptacle means in a well casing so as to be disposed below the open bore receptacle means when situated in a well casing said perforating means and said pressure surge means being interconnected to an upper tubular section which is sized and constructed to be slidably and sealingly received in an open bore receptacle means, said upper tubular section having first locking means on a wireline setting tool, and a wireline setting means having second locking means for selectively locking with said first locking means on said upper tubular section;

pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

closure means for isolating the pressure surge means and perforating means with respect to the open bore receptacle means so that the pressure in the well casing above an open bore receptacle means can be controlled independently of the pressure in the well casing below an open bore receptacle means thereby permitting well control by use of sufficient fluid pressure above an open bore receptacle means while permitting flow of fluid from the earth formations into the well casing at a negatively balanced pressure so as to enhance clean-up of the fluid communication channels produced in the earth formations by operation of the perforating means while maintaining control of the well.

41. The apparatus as defined in claim 40 and further including pressure sensing means attached to said tubular section for sensing pressure below said closure means and producing an electrical response as a function of pressure, said pressure sensing means including means for coupling an electrical response of the sensing means to an electrical conductor for transmission to the earth's surface.

42. The apparatus as defined in claim 41 and further including indicator means at the earth's surface coupled to an electrical conductor and the sensing means for indicating pressure below an open bore receptacle means.

43. The apparatus as defined in claim 41 wherein said coupling means is in the wireline setting tool.

44. The apparatus as defined in claim 43 wherein said closure means and said pressure sensing means include releasable valve connection means for permitting disconnection of a part of the pressure sensing means in the wireline setting tool from the part of the pressure sensing means below the means for isolating and including valve means for controlling the pressure across the closure means.

45. The apparatus as defined in claim 44 wherein said pressure sensing means also includes a pressure relief valve located in the wireline setting tool.

46. Perforating apparatus for use in the completion of oil wells in cooperation with an open bore receptacle means located in a well casing which traverses earth formation, comprising:

perforating means for providing fluid communication channels between the well casing and surrounding earth formations, said perforating means being adapted for interconnection with open bore receptacle means in a well casing so as to be disposed below the open bore receptacle means when situated in a well casing;

pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

closure means for isolating the pressure surge means and perforating means with respect to the open bore receptacle means so that the pressure in the well casing above an open bore receptacle means can be controlled independently of the pressure in the well casing below an open bore receptacle means thereby permitting well control by use of sufficient fluid pressure above an open bore receptacle means while permitting flow of fluid from the earth formations into the well casing at a negatively balanced pressure so as to enhance clean-up of the fluid communication channels produced in the earth formations by operation of the perforating means while maintaining control to the well, said closure means including a frangible member which can be destructed upon the application of force.

47. Perforating apparatus for use in the completion of oil wells in cooperation with an open bore receptacle means located in a well casing which traverses earth formation, comprising:

perforating means for providing fluid communication channels between the well casing and surrounding earth formations, said perforating means being adapted for interconnection with open bore receptacle means in a well casing so as to be disposed below the open bore receptacle means when situated in a well casing, said perforating means and said pressure surge means having means for interconnecting to a open bore receptacle means;

pressure surge means defined by a hollow elongated chamber at a predetermined lower pressure with respect to the formation pressure expected in the wall casing when the earth formations are placed in fluid communication with the well casing, said surge means and said perforating means being operatively coupled to one another, and receiving means in said pressure surge means for releasably receiving a plug member, and a plug member constructed to be releasably received in said pressure surge means for sealing the bore of said pressure surge means;

closure means for isolating the pressure surge means and perforating means with respect to the open bore receptacle means so that the pressure in the well casing above an open bore receptacle means can be controlled independently of the pressure in the well casing below an open bore receptacle means thereby permitting well control by use of sufficient fluid pressure above an open bore receptacle means while permitting flow of fluid from the earth formations into the well casing at a negatively balanced pressure so as to enhance clean-up of the fluid communication channels produced in the earth formations by operation of the perforating means while maintaining control of the well.

48. The apparatus as defined in claim 47 and further including pressure sensing means in said plug member for sensing pressure in the well casing.

49. The apparatus as defined in claim 48 and further including releasable valve means disposed at between the plug member and perforating means for isolating said pressure surge means from said perforating means and are operable upon firing of said perforating means for opening said pressure surge means to the well casing.

50. The apparatus as defined in claim 49 and further including additional releasable valve means where said releasable valve means enclosing said perforating means and are operable upon firing of said perforating means for opening said perforating means to the wall casing.

51. Completion apparatus for use in the completion of oil wells which traverse earth formation, comprising:

packer means having an open bore and adapted to be set in a well bore with a wireline setting tool, said packer means having a depending perforating means for providing fluid communication channels between the well casing and surrounding earth formations below the packer means when situated in a well casing;

pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

means responsive to the operation of said perforation means for opening said elongated chamber to the well casing below said packer means; and closure means for isolating the pressure surge means and perforating means with respect to the open bore of the packer means so that the pressure in the well casing above the packer means can be controlled independently of the pressure in the well casing below the packer means thereby permitting well control by use of sufficient fluid pressure above the packer means while permitting flow of fluid from the earth formations into the well casing at a negatively balanced pressure so as to enhance clean-up of the fluid communication channels produced in the earth formations by operation of the perforating means while maintaining control of the well.

52. The apparatus as defined in claim 51 wherein the open bore of said packer means includes means for releasably receiving a releasable plug member, and a releasable plug member constructed to be releasably received in said open bore for sealing off the bore of said packer means.

53. Completion apparatus for use in the completion of oil wells which traverse earth formation, comprising:

packer means having an open bore and adapted to be set in a well bore with a wireline setting tool, said packer means having a depending perforating means for providing fluid communication channels between the well casing and surrounding earth formations below the packer means when situated in a well casing said open bore having means for releasably receiving releasable plug member and a releasable plug member constructed to be releasably received in said open bore for sealing off the bore of said packer means, said plug member having a pressure relief valve, pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

means responsive to the operation of said perforation means for opening said elongated chamber to the well casing below the packer means; and closure means for isolating the pressure surge means and perforating means with respect to the open bore of the packer means so that the pressure in the well casing above the packer means can be controlled independently of the pressure in the well casing below the packer means thereby permitting well control by use of sufficient fluid pressure above the packer means while permitting flow of fluid from the earth formations into the well casing at a negatively balanced pressure so as to enhance clean-up of the fluid communication channels produced in the earth formations by operation of the perforating means while maintaining control of the well.

54. The apparatus as defined in claim 53 and further including releasable valve means disposed at between the plug member and perforating means for isolating said pressure surge means from said perforating means and operable upon firing of said perforating means for opening said pressure surge means to the well casing.

55. The apparatus as defined in claim 54 and further including additional releasable valve means where said releasable valve means enclosing said perforating means and are operable upon firing of said perforating means for opening said perforating means to the well casing.

56. Completion apparatus for use in the completion of oil wells which traverse earth formation, comprising:

packer means having an open bore and adapted to be set in a well bore with a wireline setting tool, said packer means having a depending perforating means for providing fluid communication channels between the well casing and surrounding earth formations below the packer means when situated in a well casing;

pressure surge means defined by a hollow elongated chamber at a predetermined lower pressure with respect to the formation pressure expected in the well casing when the earth formations are placed in fluid communication with the well casing, said surge means and said perforating means being operatively coupled to one another;

means responsive to the operation of said perforation means for opening said elongated chamber to the well casing below the packer means;

closure means for isolating the pressure surge means and perforating means with respect to the open bore of the packer means so that the pressure in the well casing above the packer means can be controlled independently of the pressure in the well casing below the packer means thereby permitting well control by use of sufficient fluid pressure above the packer means while permitting flow of fluid from the earth formations into the well casing at a negatively balanced pressure so as to enhance clean-up of the fluid communication channels produced in the earth formations by operations of the perforating means while maintaining control of the well; and a wireline setting tool adapted for releasable connection to said packer means, means for releasably connecting said setting tool and packer means, said setting tool being adapted to set said packer means in a well casing.

57. The apparatus as defined in claim 56 and further including casing collar locator means in said setting tool for indicating location of casing collars in a well casing.

* * * * *